US010505320B2

(12) United States Patent
Leigh et al.

(10) Patent No.: US 10,505,320 B2
(45) Date of Patent: Dec. 10, 2019

(54) CAGE ASSEMBLY

(71) Applicant: Hewlett Packard Enterprise Development LP, Houston, TX (US)

(72) Inventors: Kevin B. Leigh, Houston, TX (US); John Norton, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 16/069,162

(22) PCT Filed: Jan. 26, 2016

(86) PCT No.: PCT/US2016/014896

§ 371 (c)(1),
(2) Date: Jul. 10, 2018

(87) PCT Pub. No.: WO2017/131634

PCT Pub. Date: Aug. 3, 2017

(65) Prior Publication Data

US 2019/0027851 A1 Jan. 24, 2019

(51) Int. Cl.

| | |
|---|---|
| ***H01R 13/6595*** | (2011.01) |
| ***H01R 13/6461*** | (2011.01) |
| ***H01R 4/20*** | (2006.01) |
| ***H01R 12/72*** | (2011.01) |
| ***H01R 13/518*** | (2006.01) |
| ***H01R 12/58*** | (2011.01) |

(52) U.S. Cl.

CPC ..... *H01R 13/6595* (2013.01); *H01R 4/20* (2013.01); *H01R 12/727* (2013.01); *H01R 13/518* (2013.01); *H01R 13/6461* (2013.01); *H01R 12/585* (2013.01)

(58) Field of Classification Search

CPC .. H01R 13/6461; H01R 4/20; H01R 13/6595; H01R 12/727; H01R 12/585; H01R 12/518

See application file for complete search history.

(56) References Cited

U.S. PATENT DOCUMENTS

| | | | |
|---|---|---|---|
| 6,047,172 | A | 4/2000 | Babineau |
| 6,558,191 | B2 | 5/2003 | Bright |
| 6,685,501 | B1 | 2/2004 | Wu |
| 6,705,879 | B2 | 3/2004 | Engel |

(Continued)

FOREIGN PATENT DOCUMENTS

| | | |
|---|---|---|
| KR | 102003000392 | 1/2003 |
| KR | 102015013537 | 12/2015 |

OTHER PUBLICATIONS

Hult, R.; "Mid-Board Optical Transceivers Light Up," Jun. 2, 2014, 9 pps.

*Primary Examiner* — Briggitte R. Hammond
(74) *Attorney, Agent, or Firm* — Brooks, Cameron & Huebsch, PLLC

(57) ABSTRACT

In one example, a cage assembly can include a receiver portion to receive an electrical cable. The cage assembly can include a sidewall portion to encase the electrical cable and protect the electrical cable from electro-mechanical interference (EMI). The cage assembly can include an attachment portion to attach to a printed circuit board (PCB). The cage assembly can include a lower portion comprising an aperture that the electrical cable exits through to be mechanically attached to the PCB.

15 Claims, 5 Drawing Sheets

(56) References Cited

U.S. PATENT DOCUMENTS

| | | | | |
|---|---|---|---|---|
| 6,878,872 | B2 | 4/2005 | Lloyd | |
| 6,916,205 | B1 * | 7/2005 | Kaneko | H01R 9/0524 439/607.42 |
| 7,583,510 | B2 | 9/2009 | Wang | |
| 8,500,490 | B2 | 8/2013 | Tsou | |
| 8,622,770 | B2 | 1/2014 | Teo | |
| 9,564,724 | B2 * | 2/2017 | Ohnuki | H01R 13/6593 |
| 2005/0266729 | A1 | 12/2005 | Fukushima | |
| 2009/0130903 | A1 * | 5/2009 | Tsukashima | H01R 9/032 439/607.23 |
| 2013/0043069 | A1 * | 2/2013 | Okuyama | H01R 4/20 174/659 |
| 2014/0213102 | A1 * | 7/2014 | Figie | H01R 13/6581 439/569 |
| 2014/0220822 | A1 * | 8/2014 | Keyser | H01R 13/6592 439/607.46 |
| 2016/0056582 | A1 * | 2/2016 | Cox | H01R 13/5841 439/607.01 |

* cited by examiner

CAGE ASSEMBLY

BACKGROUND

A number of computing devices can be coupled together using a number of cables. The number of cables can include optical cables and transceivers. For example, a particular electronic system (e.g., a switch) can use a converter cable (e.g., a media converter cable) to optically couple to another electronic system (e.g., a server). The converter cable can optically couple to a particular electronic system on one cable side and electronically couple to a particular electronic system on the other cable side.

DETAILED DESCRIPTION

Figure 1:
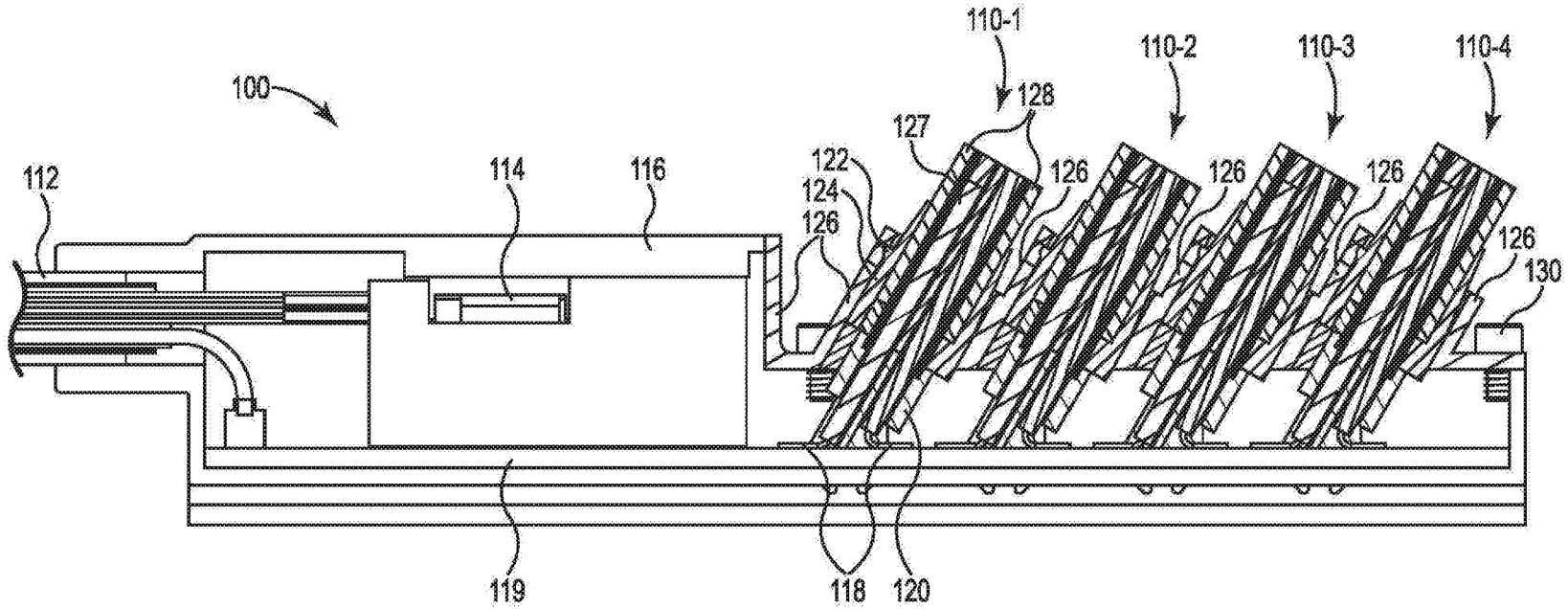
FIG. 1 illustrates a diagram of an example of an electronic system in accordance with the present disclosure.

A number of examples for a cage assembly are described herein. The cage assembly can be an electro-magnetic interference (EMI) cage assembly that minimizes EMI. EMI can refer to a disruption in operation of an electronic device and/or electronic component (e.g., cable) when they are near an electromagnetic field in the radio frequency spectrum caused by another electronic device and/or cable, respectively. The cage assembly can minimize electrical crosstalk among electrical cables.

The cage assembly can include a means of mechanical retention for retaining a cable within the cage assembly to prevent movement of the cable. The mechanical retention of the cage assembly can provide strain relief to the cables to prevent damage and/or wear and tear on the cables and cable connection joints on a printed circuit board (PCB). In addition, the cage assembly can include a mechanism to position wires of the electrical cables for soldering.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates a diagram of an example of an electronic system in accordance with the present disclosure. The electronic system 100 can include a transceiver module 116 that receives power from a powered optical cable 112. The powered optical cable 112 can optically couple to an optical transceiver 114 that is electrically coupled to servers (e.g., through printed circuit board (PCB) 119 and electrical cables 110-1, 110-2, 110-3, . . . , 110-N). In some examples, the other end of the powered optical cable 112 can be attached to an optical transceiver module and a power connector of a switch system.

The PCB 119 can be coupled to a number of cage assemblies 110-1, 110-2, 110-3, . . . , 110-N. The number of cage assemblies 110-1, 110-2, 110-3, . . . , 110-N can be coupled to the printed circuit board (PCB) 119 via cable wires 118. The cable wires 118 can be opposing-sides fix-attached points for cable 128. A first cage assembly 110-1 can include a cage (e.g., an EMI cage) 120, retention component (e.g., cable lug) 124, a retention mechanism 122 associated with the retention component 124, and a cable 128 including wires 127 within the cable 128. The cable 128 can be used to couple servers (not shown) to a switch (not shown) located at a distance via the powered optical cable 112. In some examples, a high lane-count optical transceiver (e.g., a 12-lane) of a switch port can connect to multiple server ports by using fewer lane-count (e.g., 1-lane) cables 128 and transceivers on each server.

A number of cage assemblies (e.g., including cage assemblies 110-1, 110-2, 110-3, . . . , 110-N) can be arranged in a number of columns and/or rows (as illustrated below in FIGS. 2-4 and 6). For example, the number of cage assemblies 110 can be coupled in a 2-dimensional (2-D) fashion. A retention plate 126 can be fitted (illustrated below in FIGS. 2-3) over the number of cage assemblies 110-1 to 110-N to retain the cage assemblies 110-1 to 110-N in place above the PCB 119. A fastener (e.g., a retention screw) 130 can hold the retention plate 126 in place on the transceiver module 116.

The cage 120 of a first cage assembly 110-1 can be an EMI cage that includes sidewalls that prevent EMI radiation from spreading to other neighboring wires in neighboring cage assemblies (e.g., cage assemblies 110-2, 110-3, . . . 110-N). EMI radiation can refer to radiant energy that is released by electromagnetic field. The cage 120 can also prevent electrical crosstalk among electrical cables of the neighboring cage assemblies 110-2 to 110-N. In one example, electrical crosstalk can happen when signal level transitions in a first electrical cable (e.g., a cable of cage assembly 110-1) cross-couple electromagnetic field and distort the signal levels in another electrical cable (e.g., a cable of cage assembly 110-2) in the electrical system 100. In another example, electrical crosstalk can happen when signal level transitions in electrical cables (e.g., cables of cage assemblies 110-1, 110-3) cross-couple electromagnetic field and distort the signal levels in another electrical cable (e.g., a cable of cage assembly 110-2) in the electrical system 100. In this way, as illustrated, the number of cage assemblies 110 can prevent EMI radiation and/or electrical crosstalk in a 2-D direction.

Figure 2:
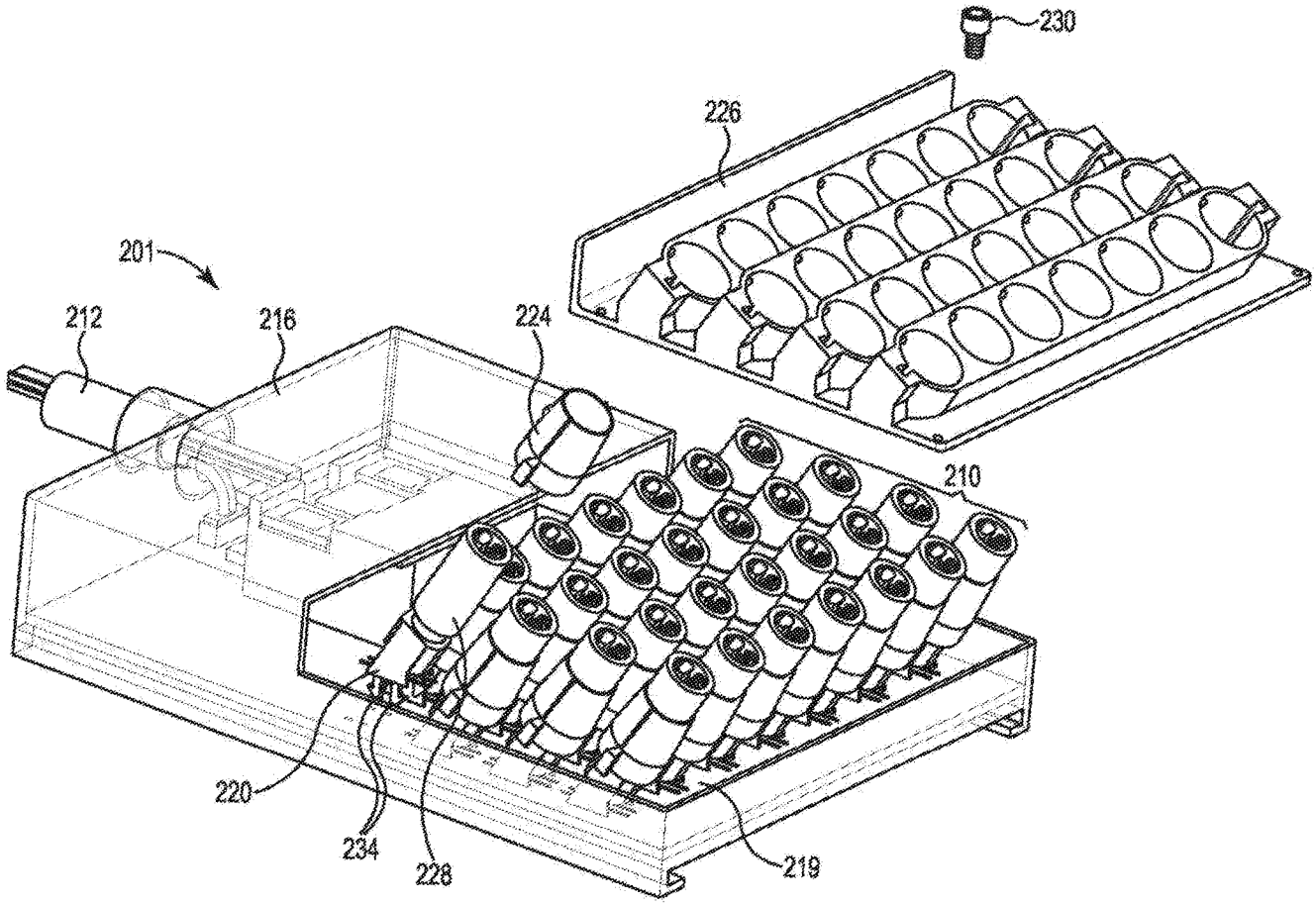
FIG. 2 illustrates a diagram of an example of a cage assembly system in accordance with the present disclosure.

FIG. 2 illustrates a diagram of an example of a cage assembly in accordance with the present disclosure. A system 201 including a powered optical cable 212, a transceiver module 216, a printed circuit board (PCB) 219, and a number of cage assemblies 210. Each of the number of cage assemblies 210 can include a cable 228, an EMI cage 220, a retention component (e.g., cable lug) 224, and an attachment portion 234 to attach a particular cage assembly to the PCB 219. A retention component 224 can be cylindrical in shape and a cable 228 can be inserted into an aperture and/or opening of an upper portion of the retention component 224 as the cable 228 is installed into system 201. The cable 228 can be inserted through an aperture at an upper portion of an EMI cage 220. Cable wires (not illustrated in FIG. 2) of the cable 228 can then be attached to the PCB 219.

The retention component 224 is lifted off of a first cage assembly for illustrative purposes and can be slid onto the cable 228. The number of cage assemblies 210 other than the first cage assembly mentioned is shown as including the retention components slid over their corresponding cables.

A retention plate 226 is shown as separate from the system 201 for illustrative purposes. The retention plate 226 can be slid over the number of cage assemblies 210 and can retain the number of cage assemblies in place. A retention mechanism (e.g., a retention screw, a locking tab, etc.) 230 can hold the retention plate 226 in place on the PCB 219. The retention mechanism 230 is illustrated as a screw but examples are not so limited. The retention mechanism 230 can be a number of different fastening mechanisms that couple, attach, and/or adhere the retention plate 226 to the system 201. In this way, each of the number of cage assemblies 210 can be held in place both front to back and side to side within the array of the number of cage assemblies 210, as illustrated.

Figure 3:
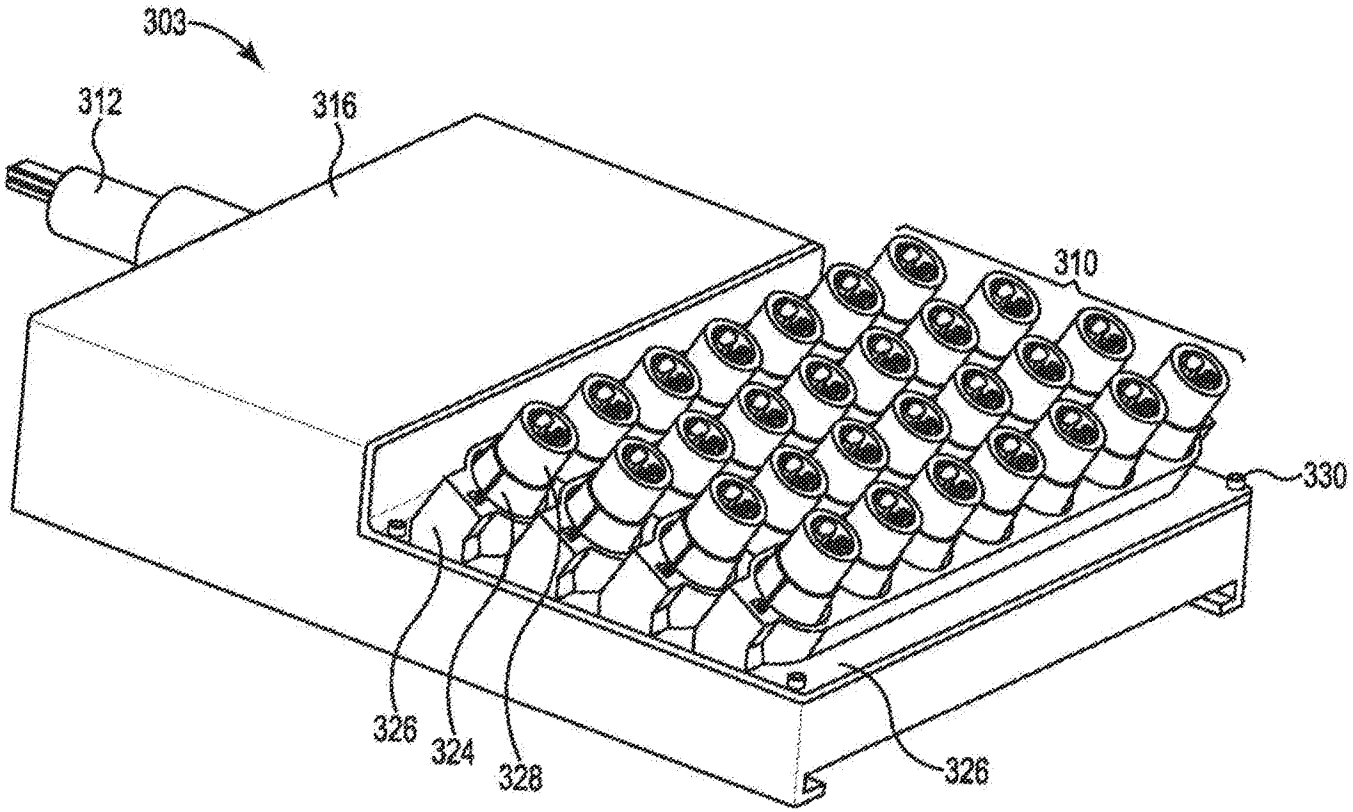
FIG. 3 illustrates a diagram of an example of a cage assembly system in accordance with the present disclosure.

FIG. 3 illustrates a diagram of an example of a cage assembly system 303 in accordance with the present disclosure. FIG. 3 is an example of a retention plate 326 being placed over the number of cage assemblies 310. The retention plate 326 can fit securely around each of the corresponding retention components (e.g., retention component 324 of a first cage assembly) where each of the retention components (e.g., cable lugs) holds a corresponding cable (e.g., cable 328 in the first cage assembly) in place. The number of cage assemblies 310 include a cable (e.g., such as cable 328 in a first cage assembly) that is coupled to a power optical cable 312 through a transceiver module 316.

Figure 4:
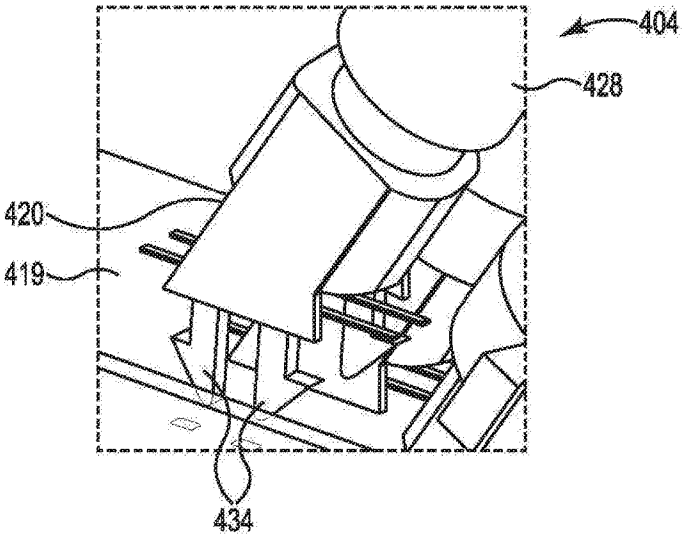
FIG. 4 illustrates a diagram of an example of a cage assembly in accordance with the present disclosure.

FIG. 4 illustrates a diagram of an example of a cage assembly 404 in accordance with the present disclosure. FIG. 4 is a close-up view of an example cage assembly (e.g., such as cage assembly 110-1 in FIG. 1). The cage assembly 404 can include a cable (e.g., an electrical cable) 428 inserted into a receiver portion of an EMI cage 420. The receiver portion of the EMI cage 420 can be an aperture at an upper portion for the cable 428 to slide through. An attachment portion 434 of the EMI cage 420 can mechanically lock and/or click into the PCB 419. The attachment portion 434 can be pushed down toward the PCB 419 to lock the EMI cage 420 into place and secure it from moving and thus secure the cable 428 from moving left to right, front to back, etc.

The EMI cage 420 can be cylindrical so that a cable can be inserted through it. In this way, the EMI cage 420 can protect neighboring cables from EMI in a 2-D fashion even though cables may be close together. This can allow for closer placement of an array of cables. The cable 428 can include cable wires (e.g., such as cable wires 118 and 218 in FIGS. 1 and 2, respectively) that are coupled (e.g., soldered, connected, attached, etc.) to a PCB 419.

Figure 5:
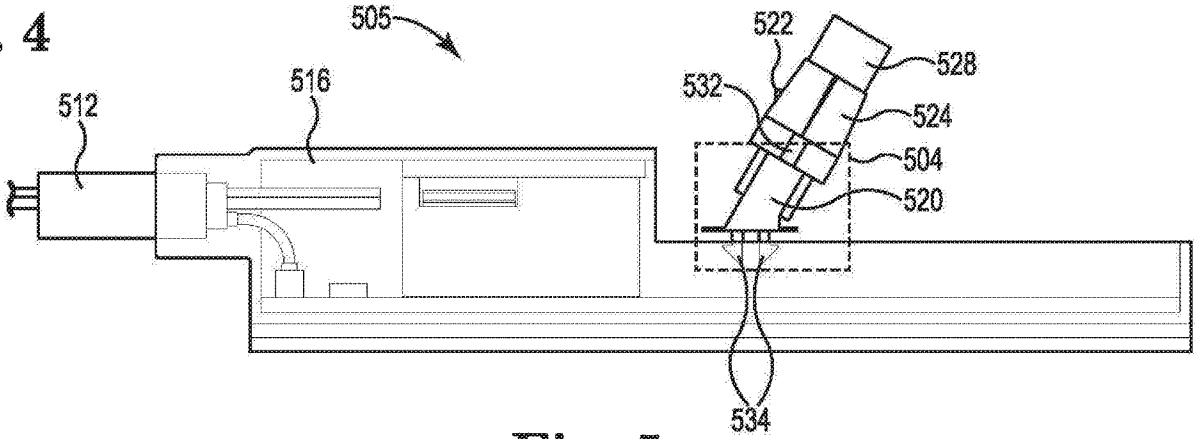
FIG. 5 illustrates a diagram of an example of a cage assembly system in accordance with the present disclosure.

FIG. 5 illustrates a diagram of an example of a cage assembly system 505 in accordance with the present disclosure. The cage assembly system 505 can include a powered optical cable 512, a transceiver module 516, and at least one cage assembly (e.g., cage assembly 110-1 in FIG. 1). The cage assembly can include an EMI cage 520, a retention component (e.g., cable lug) 524, a cable 528, and an attachment portion 534. The attachment portion 534 can include two prongs that are inserted into a PCB to fasten the cage assembly into the PCB.

The retention component 524 can include an attachment mechanism 532 (e.g., an interlocking piece that interlocks with a neighboring attachment mechanism of a neighboring cage assembly). For example, an attachment mechanism of a first cage assembly can be a particular shape for an attachment mechanism of a second neighboring cage assembly to slide into and be locked in place (as illustrated further in FIG. 6 by attachment mechanism 632). The retention component 524 can include a locking mechanism 522 to lock the retention component 524 to a retention plate (e.g., retention plate 126, 226, 326 in FIGS. 1-3, respectively). In this way, a cage assembly can be retained in a particular position with respect to the retention plate by a locking mechanism 522 and in a particular position with respect to neighboring cage assemblies by a retention component 524. The portion illustrated in window 504 of FIG. 5 can correlate to what is illustrated as cage assembly 404 in FIG. 4.

Figure 6:
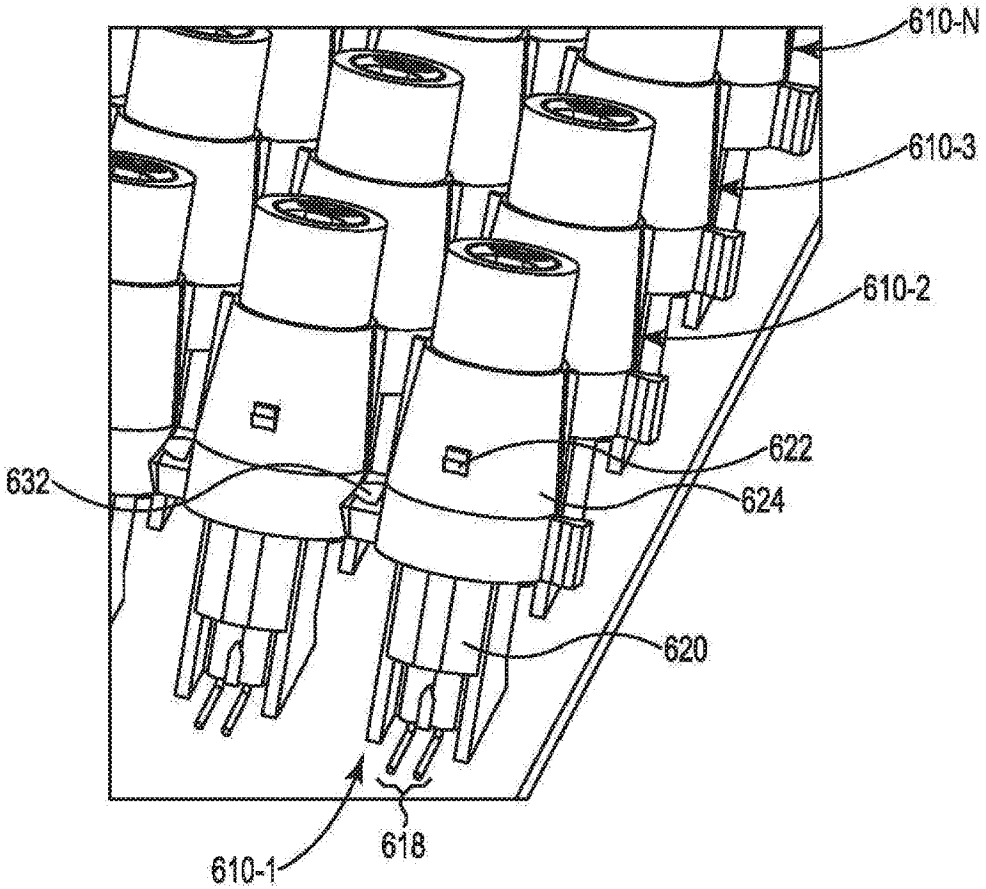
FIG. 6 illustrates a diagram of an example of a cage assembly in accordance with the present disclosure.

FIG. 6 illustrates a diagram of an example of a cage assembly system in accordance with the present disclosure. The cage assembly system of FIG. 6 can include a number of cage assemblies 610-1, 610-2, 610-3, . . . , 610-N. For example, cage assemblies 610-1 to 610-N can correspond to cage assemblies 110-1 to 110-4 in FIG. 1. That is, a first column of cage assemblies 610-1 to 610-N can be neighboring additional columns of cage assemblies, as illustrated in FIG. 6, and form rows of cage assemblies to make up an array of cage assemblies (as illustrated in FIGS. 2-3).

Each of the number of cage assemblies 610-1 to 610-N can include a locking mechanism, such as locking mechanism 622 of cage assembly 610-1, that locks each corresponding cage assembly to a retention plate (not illustrated in FIG. 6 but illustrated in FIGS. 1-3). The locking mechanism 622 can be attached to a retention component (e.g., cable lug) 624. The retention component 624 includes an attachment mechanism 632 that attaches a cage assembly to a neighboring cage assembly. Each of the cage assemblies, such as cage assemblies 610-1 to 610-N, includes an EMI cage 620. The EMI cage 620 can reduce EMI interference from neighboring cage assemblies.

An example of an assembly of a cage assembly can include a number of steps. For example, a cable (e.g., cable 228 and 328 in FIGS. 2-3, respectively) can be inserted through a retention plate (e.g., retention plate 226 and 326 in FIGS. 2-3, respectively). The cable can be inserted through a cable lug (e.g., retention component 624) and the cable can be crimped to the cable lug. An end of the cable can be inserted into an EMI cage (e.g., EMI cage 620). Cable wires (e.g., wires 118 in FIG. 1) of the cable can then be stripped, dressed, and/or prepped to be soldered to a printed circuit board (PCB) (e.g., PCB 119 and 219 in FIGS. 1-2, respectively).

Each EMI cage (e.g., EMI cage 620) with a cable inserted within it is installed on the PCB (e.g., PCB 119/219). A number of mechanical retention features (e.g., such as retention component 624, attachment mechanism 632, locking mechanism 622, etc.) can hold the EMI cage during the soldering process (e.g., to solder the wires to the PCB) while the EMI cage retains the cable wires in place on PCB pads. Cables associated with each of the cage assemblies (e.g., cage assemblies 210, 310, 610, etc.) can be arranged (such as in FIGS. 2-3, and 6) in such a way to allow solder irons access from a top of the cage assembly system for manual assembly methods of the wires, etc.

The example assembly steps can be repeated for each cable of the cage assemblies, such as 210 and 310 in FIGS. 2-3. Each adjacent cable lug can be interlocked as a new EMI cage with corresponding cable is installed on the PCB.

The cable wires (e.g., such as cable wires 618) can be permanently affixed to PCB pads. The cable wires can be permanently affixed using an automation method such as a laser weld, solder reflowed, etc. In this way, electrical connectors can be avoided and consistent cable dressing can be provided. A higher density of cables can be provided in an array of cables (e.g., such as cables arrayed in the number of cage assemblies in FIGS. 2-3).

Figure 7:
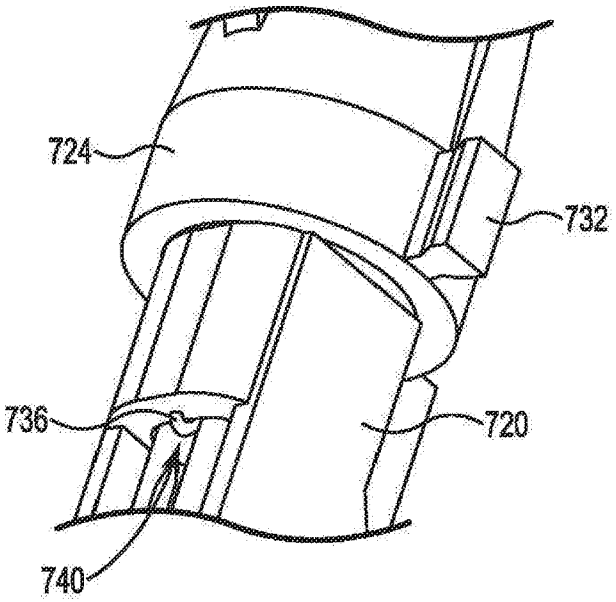
FIG. 7 illustrates a diagram of an example of a cage assembly in accordance with the present disclosure.

FIG. 7 illustrates a diagram of an example of a cage assembly in accordance with the present disclosure. The cage assembly (e.g., such as cage assembly 610-1 in FIG. 6) can include a retention component (e.g., cable lug) 724 including an attachment mechanism 732. The cage assembly in FIG. 7 can include an EMI cage 720 that reduces EMI interference. A cable (not illustrated) can pass through the retention component 724 and the EMI cage 720 and have a drain wire 736 that is terminated and/or crimped to the EMI cage 720.

As used herein, "a" or "a number of" something can refer to one or more such things. For example, "a number of widgets" can refer to one or more widgets. The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A cage assembly, comprising:
a receiver portion to receive an electrical cable;
a sidewall portion to:
encase the electrical cable; and
protect the electrical cable from electro-mechanical interference (EMI);
an attachment portion to attach to a printed circuit board (PCB); and
a lower portion comprising an aperture that the electrical cable exits through to be mechanically attached to the PCB.

2. The cage assembly of claim 1, wherein the sidewall portion:
prevents electrical crosstalk between the electrical cable and a neighboring electrical cable; and
positions wires of the electrical cables for attaching the wires to the PCB.

3. The cage assembly of claim 1, comprising a retention component that fits over the receiver portion and is crimped to the electrical cable.

4. The cage assembly of claim 3, wherein the retention component comprises a retention mechanism that:
attaches to a neighboring retention component of a neighboring electrical cable; and
minimizes movement of the electrical cable.

5. The system of claim 1, comprising:
a retention component that fits over the receiver portion; and
a retention plate that fits over the retention component and the receiver portion;
wherein the retention component comprises a locking mechanism to lock the retention component to the retention plate.

6. An apparatus, comprising:
a cage assembly to receive an electrical cable, wherein the cage assembly comprises:
an attachment component to attach the cage assembly to a printed circuit board (PCB); and
sidewalls to protect the cage assembly and the corresponding electrical cable from electro-mechanical interference (EMI);
a retention component that fits over a top portion of the cage assembly and is crimped to the electrical cable, wherein the retention component retains the cage assembly and the retention component to a retention plate; and
the retention plate to fit over the retention component and the corresponding cage assembly to retain the retention plate and the cage assembly in place.

7. The apparatus of claim 6, comprising a plurality of cage assemblies each including a corresponding electrical cable, wherein the retention plate fits over the plurality of cage assemblies and retains the corresponding electrical cables in place to minimize movement.

8. The apparatus of claim 6, wherein the sidewalls of the cage assembly comprise cross-talk shields that are electrically coupled to the PCB and prevent EMI from neighboring electrical cables from affecting the electrical cable.

9. The apparatus of claim 6, comprising a plurality of cage assemblies including the cage assembly positioned in an array, wherein the retention plate fits over each of the plurality of cage assemblies and prevents movement of the array.

10. The apparatus of claim 9, comprising a plurality of electrical cables associated with each of the plurality of cage assemblies that are mechanically coupled to the PCB, wherein the array includes a greater number of electrical cables due to the mechanical coupling.

11. A method, comprising:
inserting an electrical cable through a retention plate;
inserting the electrical cable through a lug;
crimping the lug around the electrical cable;
inserting an end of the electrical cable into an electro-mechanical (EMI) cage; and
attaching wires of the end of the electrical cable to a printed circuit board (PCB).

12. The method of claim 11, comprising locking the EMI cage to the PCB board using an attachment portion of the EMI cage.

13. The method of claim 11, comprising:
inserting a plurality of electrical cables through the retention plate; and
locking each corresponding lug into the retention plate.

14. The method of claim 13, comprising locking each corresponding lug to a neighboring lug.

15. The method of claim 13, comprising:
retaining the plurality of electrical cables in place by:
the corresponding lugs attaching the plurality of electrical cables to corresponding neighboring lugs; and
a plurality of attachment portions of each corresponding EMI cage that lock the corresponding EMI cages to the PCB; and
wherein the wires are attached after the plurality of electrical cables are retained.

* * * * *